US007145108B2

(12) United States Patent
Kanel et al.

(10) Patent No.: US 7,145,108 B2
(45) Date of Patent: Dec. 5, 2006

(54) CONFIGURABLE HEATING PAD CONTROLLER

(75) Inventors: Christopher S. Kanel, Hudson, NY (US); Robert Sherwood, El Paso, TX (US)

(73) Assignee: Kaz, Incorporated, New York, NY (US)

( * ) Notice: Subject to any disclaimer, the term of this patent is extended or adjusted under 35 U.S.C. 154(b) by 0 days.

(21) Appl. No.: 10/625,472

(22) Filed: Jul. 22, 2003

(65) Prior Publication Data

US 2005/0016989 A1 Jan. 27, 2005

(51) Int. Cl.
*H05B 1/02* (2006.01)

(52) U.S. Cl. ..... 219/492; 219/502; 219/212; 323/235

(58) Field of Classification Search ..... 219/212, 219/492, 497, 499, 501, 506, 483–486; 307/117, 307/38–41; 323/235, 236, 319
See application file for complete search history.

(56) References Cited

U.S. PATENT DOCUMENTS

| | | | | |
|---|---|---|---|---|
| 2,819,371 | A | | 1/1958 | Aldrich et al. |
| 3,329,887 | A | | 7/1967 | Schaeve |
| 3,375,347 | A | | 6/1968 | Seney |
| 3,700,933 | A | | 10/1972 | Harkenrider et al. |
| 3,702,921 | A | | 11/1972 | Thelen |
| 3,842,243 | A | | 10/1974 | Gregory |
| 3,854,033 | A | | 12/1974 | Edge |
| 4,002,882 | A | | 1/1977 | McCutchen |
| 4,238,672 | A | | 12/1980 | Siess |
| 4,243,875 | A | | 1/1981 | Chang |
| 4,277,670 | A | | 7/1981 | Mori et al. |
| 4,283,619 | A | | 8/1981 | Abe |
| 4,334,147 | A | | 6/1982 | Payne |
| 4,377,738 | A | | 3/1983 | Berg |
| 4,383,254 | A | * | 5/1983 | Gemmell et al. ..... 345/156 |
| 4,777,350 | A | | 10/1988 | Crocket et al. |
| 4,950,868 | A | | 8/1990 | Moss et al. |
| 5,023,430 | A | | 6/1991 | Brekkestran et al. |
| 5,032,705 | A | | 7/1991 | Batcheller |
| 5,105,067 | A | | 4/1992 | Brekkestran et al. |
| 5,185,513 | A | | 2/1993 | Pacileo |
| 5,302,807 | A | | 4/1994 | Zhao |
| 5,317,130 | A | | 5/1994 | Burkett et al. |
| 5,657,640 | A | * | 8/1997 | Takada et al. ..... 62/186 |
| 5,708,256 | A | | 1/1998 | Montagnino et al. |
| 5,938,960 | A | * | 8/1999 | Lulofs et al. ..... 219/492 |
| 6,060,698 | A | * | 5/2000 | Petrides et al. ..... 219/492 |
| 6,311,608 | B1 | * | 11/2001 | Hardin et al. ..... 99/326 |

* cited by examiner

*Primary Examiner*—Mark Paschall
(74) *Attorney, Agent, or Firm*—Darby & Darby

(57) ABSTRACT

According to the present invention, a heating pad controller incorporating a discrete ASIC (Application Specific Integrated Circuit) is provided which varies the duty cycle characteristics of a periodic signal during which power is applied to a heating pad heating element during a portion of the signal ("on" time). An oscillator circuit is used to produce a controlled duty cycle control signal for controlling the power applied to the heating pad by varying the on-time of the duty cycle. User control of the length of the on-time of the duty cycle is provided by way of a user controlled switch, thereby providing for a plurality of controller operating modes (e.g., WARM, LOW, MEDIUM, HIGH, etc.). To configure the duty cycle for each heat setting the heating pad controller utilizes switchable electrical components of varying impedance connected to the ASIC. A heating pad controller according to the present invention can be configured for use with heating pads of varying sizes simply by installing electrical components with the appropriate impedance during manufacture of the circuit board.

15 Claims, 10 Drawing Sheets

Oscillator Circuit

Varying Resistance Of Oscillator Circuit

CONFIGURABLE HEATING PAD CONTROLLER

FIELD OF THE INVENTION

The present invention generally relates to the field of heating system controllers. More specifically, the present invention relates to a controller for a heating pad.

BACKGROUND OF THE INVENTION

Heating pads are commonly used by individuals to provide controlled and localized heating to particular body parts or areas. The heating pads may be incorporated into an article of clothing, such as a glove, or may be provided as a stand alone article to be placed on an area which is desired to be heated. Heating pads typically include a heating element, such as a large resistive element, which is heated by the application of power. Heating pads also include a thermostat or other temperature control mechanism which allows a user to vary and control the amount of heat provided by the heating pad.

Heating pad temperature control may be achieved by controlling the amount of power delivered to the heating element within the heating pad. The amount of power is in turn controlled by altering either the amount of continuous power applied to the heating element, or intermittently applying power to thereby alter the amount of time during which power is applied to the heating element. This latter approach to temperature control is often referred to as "duty cycle" control, since it is the amount of on-time and off-time of the applied power that is being controlled.

Conventional heating pad controllers typically include a thermostat for sensing the heating pad temperature and turning off power to the heating element once the heating pad has reached a desired temperature. An additional "tickler" heater in thermal contact with the thermostat is selectively turned on to accelerate the turn-off of the thermostat, thus, shortening the on-time of the heating element and maintaining the heating element at a lower overall temperature. When a desired temperature setting is activated by a user controlled switch, current is supplied to a "tickler" heater. The added heat generated by the tickler heater in conjunction with the heat generated by the heating element causes the thermostat to reach its turn-off temperature sooner than it would without the application of the additional "tickler" heater. When the thermostat turns off, all power to the heating element and the tickler heater is also turned off. This results in a lower heating pad temperature setting since the heater on-time is shortened due to the quick turn-off of the thermostat.

FIG. 1 shows a conventional heating pad controller which includes a "tickler" heater H1 for regulating the different heat settings. As shown in FIG. 1, thermostats T1 and T2 sense the temperature of the heating pad which is heated by heater H3

Additionally, thermostat T1 is in thermal contact with heater H1, a small "tickler" heater. User control is provided via switch S, which is a four position switch. In the high switch setting, contacts S3 and S4 are connected together; in the medium setting, contacts S3 and S4 are connected together and contacts S2 and S5 are connected together; in the low setting, contacts S2 and S5 are connected together; while in the off setting, contacts S1 and S6 are connected together. In the low setting, all the current flows through heater H1, which in turn heats thermostat T1 causing it to prematurely turn off, thus maintaining primary heater H3 at a lower overall temperature. The current also flows through heater H3 causing it to warm up. In the medium setting, some of the current is diverted through heater or resistor H2, which is more thermally isolated from thermostats T1 and T2 than heater H1. This results in heater H1 applying less heat to thermostat T1 such that thermostat T1 remains on for a relatively longer period of time, thus keeping heater H3 at a medium temperature. In the high setting, no current flows through heater H1, and thus there is no additional or accelerated heating of thermostat T1. This results in heater H3 being maintained at the highest temperature level limited only by thermostats T1 and T2 which are typically required in order to meet the prevailing safety codes for such devices.

SUMMARY OF THE INVENTION

According to the present invention, a heating pad controller incorporating a discrete ASIC (Application Specific Integrated Circuit) is provided which varies the duty cycle characteristics of a periodic signal during which power is applied to a heating pad heating element during a portion of the signal ("on" time). An oscillator circuit is used to produce a controlled duty cycle control signal for controlling the power applied to the heating pad by varying the on-time of the duty cycle. The timing of the oscillator circuit is primarily determined by the charging of a capacitor, which in turn is controlled by the resistance through which the capacitor charges. User control of the length of the on-time of the duty cycle is provided by way of a user controlled switch. The switch is used to selectively vary the resistance through which a capacitor in the oscillator circuit charges up. The larger the resistance selected by the switch, the longer the charging time of the capacitor, and the longer the on-time will be, or equivalently, the longer the time period between off-times of the duty cycle.

The output of the oscillator circuit, or more specifically the voltage across the capacitor, is input to a Schmidt trigger. When the voltage across the capacitor reaches a level sufficient to cause the Schmidt trigger to switch, the output of the Schmidt trigger changes state, dropping to a specific voltage inherent to the Schmidt trigger. The change in state of the Schmidt trigger turns on an open drain transistor which acts as a discharge path for the capacitor by supplying a ground connection to the positive terminal of the capacitor. When the discharging capacitor reaches a certain low voltage, the Schmidt trigger will once again change states, this time going from low to high and open circuiting the transistor, allowing the capacitor to begin charging again. The Schmidt trigger will continue to change states in this manner as long as a voltage equal to or greater than the Schmidt trigger's threshold voltage is applied across the capacitor. Throughout the continuous charging and discharging of the capacitor, the output of the Schmitt trigger is essentially a square wave. This square wave output is input to a counter which counts a predetermined number of voltage changes (oscillator cycles) before cutting off power to the heating element. Thus, a higher frequency of oscillation in the duty cycle will cause the counter to reach its predetermined count sooner, allowing the controller to cut off power to the heating element sooner. If a higher resistance value is selected by way of the user controlled switch, the capacitor will take longer to charge and the counter will have to wait longer to reach its predetermined count, thus, power to the heating element will remain on for a longer period of time.

Additionally, when the heating pad is first turned on or when the desired temperature setting is increased, continuous power, i.e., 100% duty cycle operation, is initiated in order to rapidly heat the heating pad to the desired temperature. Similarly, when the desired temperature setting is decreased, no power is applied to the heating element, i.e., 0% duty cycle operation. An automatic shut off feature is also provided, whereby the circuit shuts off power to the heating element whenever a predetermined amount of time passes with no user input.

The heating pad controller utilizes switchable electrical components of varying impedance connected to the ASIC to configure the duty cycle for each heat setting. In like manner, the warm up time for each heat setting is selected using a combination of impedances connected to the ASIC. The heating pad controller can be configured for use with heating pads of varying sizes simply by installing electrical components with the appropriate impedance during manufacture of the circuit board.

A plurality of controller operating modes (e.g., WARM, LOW, MEDIUM, HIGH, etc.) are provided by the present invention. Which operating modes are to be implemented in a given controller model is determined at the time of manufacture by installing an LED (light emitting diode) corresponding to each of the modes of operation to be included. On power-up the controller checks for the presence of each LED corresponding to an operation mode, and if an LED is omitted, the omission will be detected and the corresponding mode bypassed during operation.

Additionally, the heating pad controller can operate using different types of switches, by connecting an ASIC MODE pin to either ground or power. Thus, either a slide switch configuration or momentary pushbuttons can be used to select the heat setting. The controller can operate at AC frequencies of 50 Hz or 60 Hz, selectable via a logic signal applied to an ASIC pin.

BRIEF DESCRIPTION OF THE DRAWINGS

Other objects, features and advantages of the invention will be more clearly understood when taken together with the following detailed description of an embodiment which will be understood as being illustrative only, and the accompanying drawings reflecting aspects of that embodiment, in which.

DETAILED DESCRIPTION OF THE PREFERRED EMBODIMENTS

Figure 1:
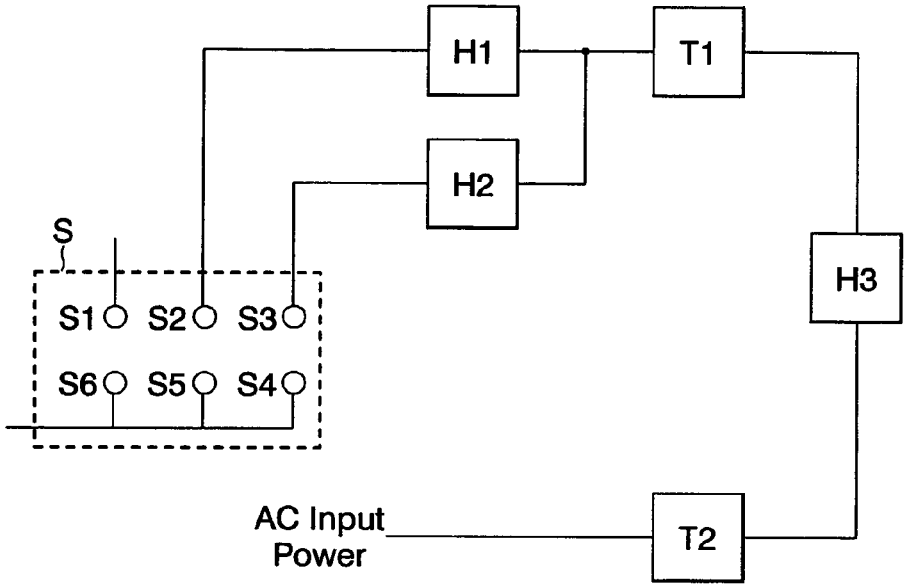
FIG. 1 (Prior Art)
FIG. 1 is a block diagram of a prior art heating pad control system.
Figure 2:
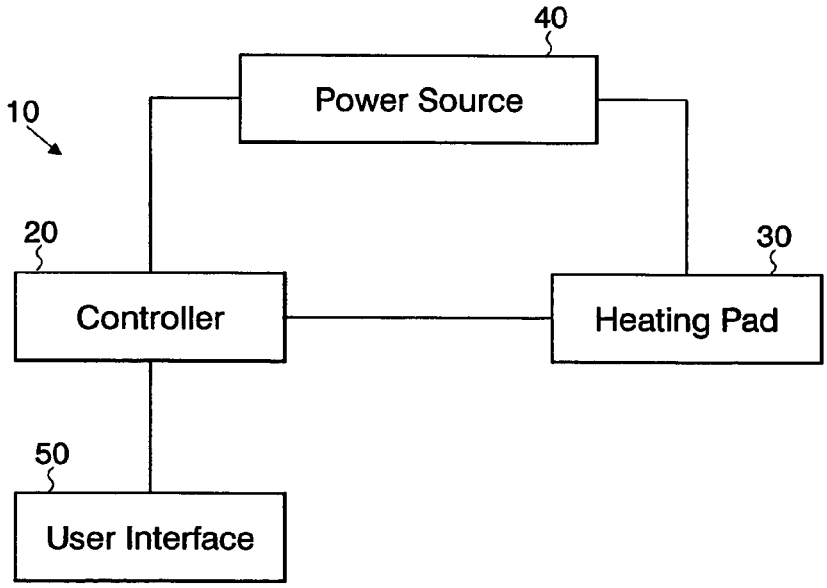
FIG. 2 is a block diagram of a heating pad control system according to the present invention.

FIG. 2 is a block diagram illustrating a heating pad control system 10 according to the present invention. Although the present description is given in terms of a heating pad, it should be understood that the present invention is likewise applicable to the control of heating devices in general. Control system 10 includes a controller 20 which controls heating pad 30. A power source 40 is supplied to both the controller 20 and the heating pad 30. Essentially, controller 20 controls the power from power source 40 that is applied to heating pad 30. Heating pad 30 includes a heating element (not shown) which converts the electrical energy from power source 40 into thermal energy to produce heat. The heating element may be a resistive element through which current is passed and heat generated therein. User interface 50 is connected to the controller 20 and allows the user to turn the system on/off and control the desired temperature of heating pad 30.

Figure 3:
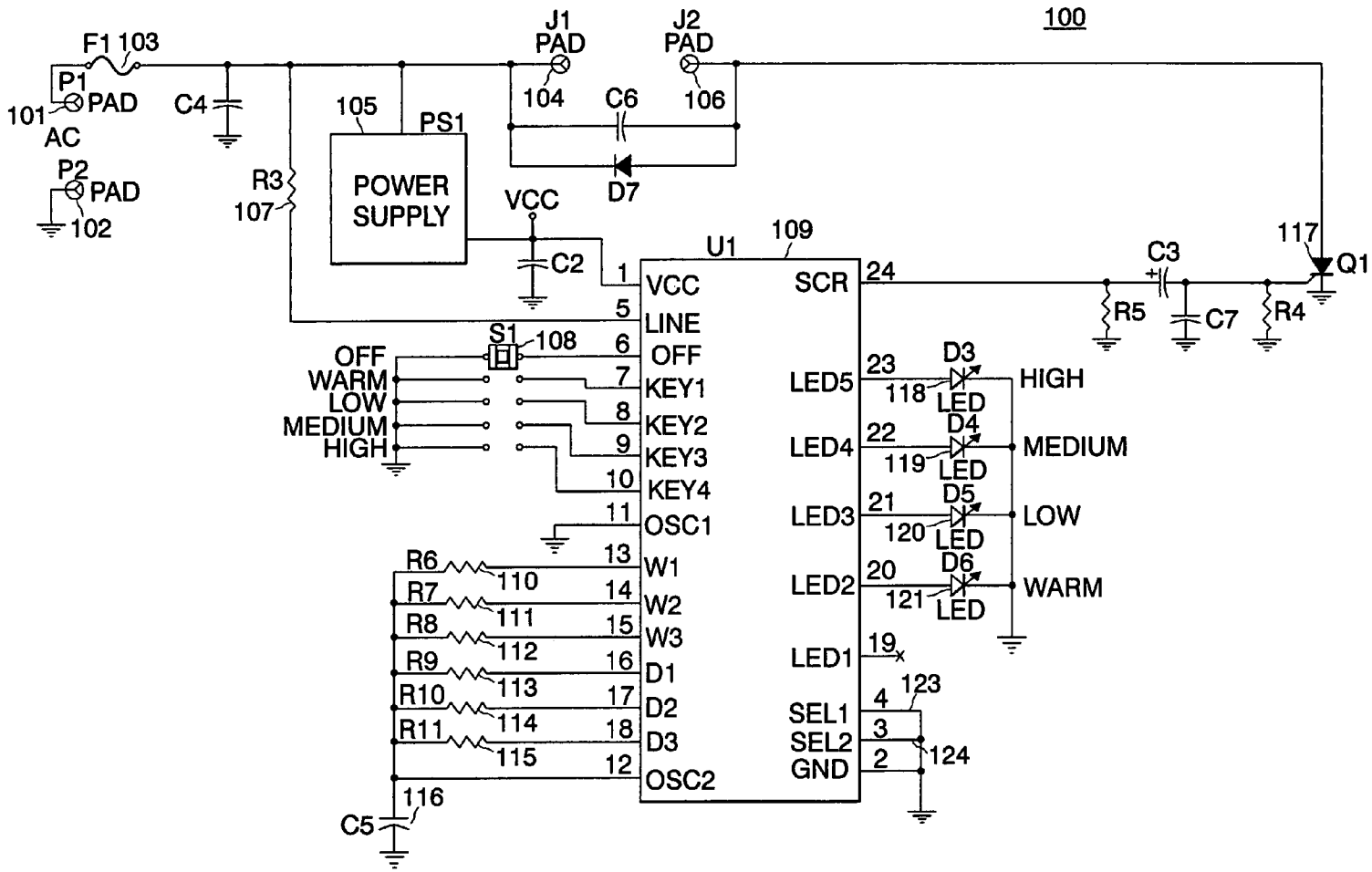
FIG. 3 is an electrical circuit schematic of a heating pad controller according to a first embodiment of the present invention.
Figure 7:
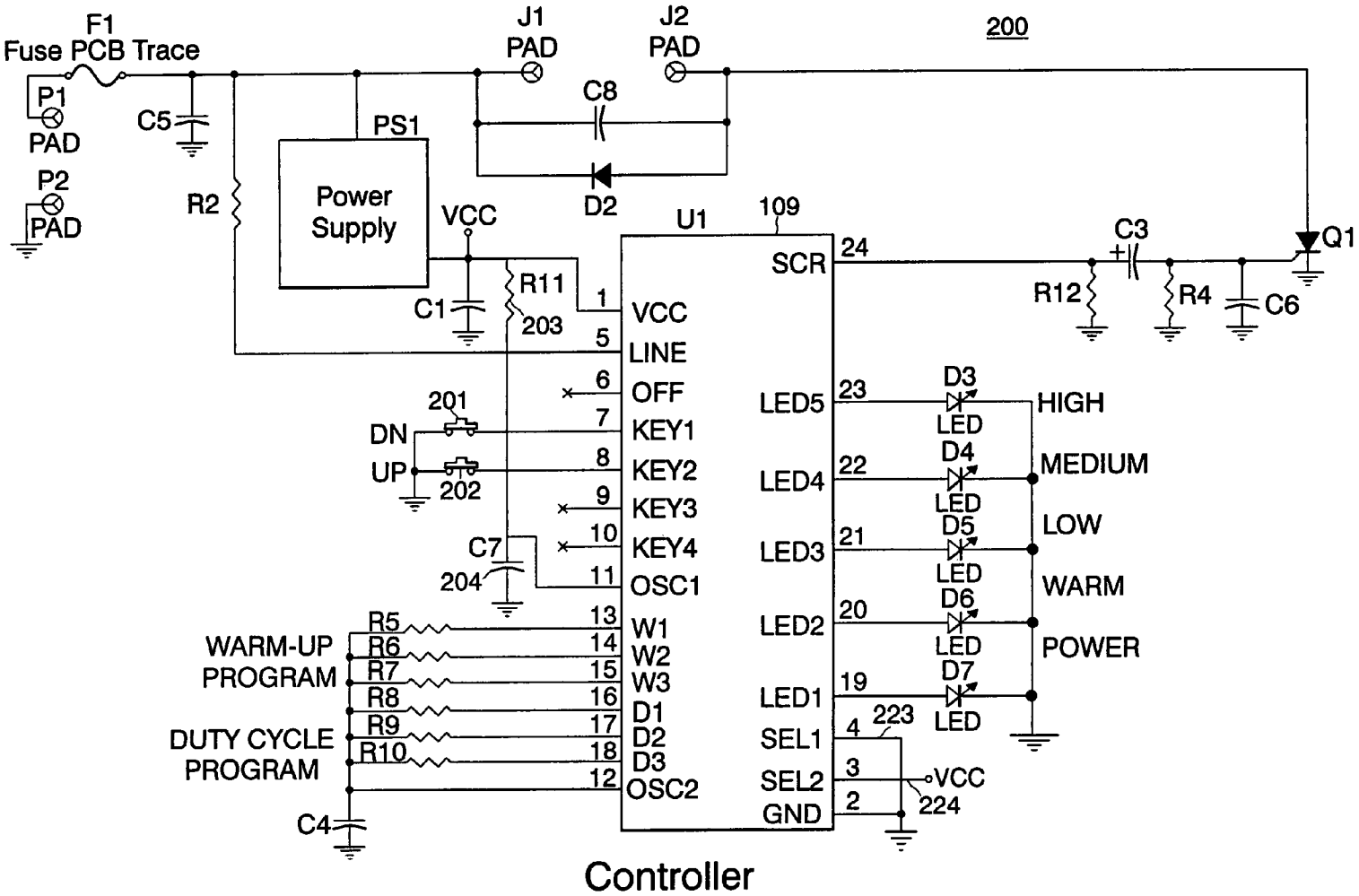
FIG. 7 is an electrical circuit schematic of a heating pad controller according to a second embodiment of the present invention.

First and second embodiments of controller 20 are shown in more detail in FIGS. 3 and 7. Referring now to FIG. 3, therein is shown controller 100 which is used to selectively provide power to a heating pad (not shown) which is connected across terminals 104 and 106.

Controller 100 includes an oscillator circuit which is used to produce a controlled duty cycle control signal for controlling the power applied to the heating pad. The timing of the oscillator circuit is primarily determined by the charging and discharging of capacitor 116. Specifically, since power is applied 100% of the time in the HIGH setting, only the MEDIUM, LOW, and WARM settings utilize programmable or adjustable duty cycles, and therefore, use the oscillator circuit to produce a controlled duty cycle. Charging of capacitor 116 is accomplished through duty cycle resistors 113, 114, and 115, corresponding to MEDIUM, LOW, and, WARM settings, respectively. Thus, for example, when the WARM setting is selected via switch 108, the ASIC 109 applies a voltage via output pin D3 to resistor 115, thereby charging capacitor 116 through resistor 115. Resistors 113 and 114, corresponding to MEDIUM AND LOW settings respectively, are not used when controller 100 is set to WARM mode, thus ASIC 109 output pins D1 and D2 are open circuited preventing the application of voltage to these pins.

Warm-up mode resistors 110, 111 and 112 are connected to ASIC 109 pins W1, W2 and W3, respectively, and are used for fast warm-up in heat modes MEDIUM, LOW AND WARM, respectively. During duty-cycle mode voltage is not supplied to these ASIC pins, since the resistors connected to these pins are used primarily in warm-up mode and are not used when the ASIC 109 enters duty cycle mode. As such, ASIC 109 turns output pins W1, W2 and W3 off, thereby ensuring that capacitor 116 is no longer being charged through warm-up resistors 110, 111, or 112. Turning off ASIC 109 output pins W1, W2 and W3 can be accomplished by open circuited these output pins as discussed below.

The capability of ASIC 109 to open-circuit certain output pins, preventing the application of voltage at such pins, can be achieved by a variety ways, for example, one such method uses open drain transistors with external pull-up resistors. When a heat setting is selected via switch 108 the open drain transistor connected to the corresponding ASIC pin requiring voltage is turned ON and a connection to the DC power supply is complete. In this condition, the ASIC 109 output pins not used to implement the selected heat setting are essentially open circuited by the high impedance created when the transistor is not active (OFF), or in other words, if an ASIC 109 output pin is not active (ON) it is open circuited. This is useful in that only the resistor being used to implement the selected heating mode is driven by the ASIC, thus the unused resistors will not reduce the resistance through which capacitor 116 charges by acting in parallel with the selected warm-up or duty-cycle resistor. Alternatively, turning off specific ASIC 109 output pins can be accomplished by connecting ASIC 109 output pins D1, D2, D3, W1, W2 and W3 internally to the output of open-drain AND gates in which case the ASIC 109 output pins are either in an ON condition at a logic high (5 Volt output) or in an OFF condition (open circuit).

Figure 4:
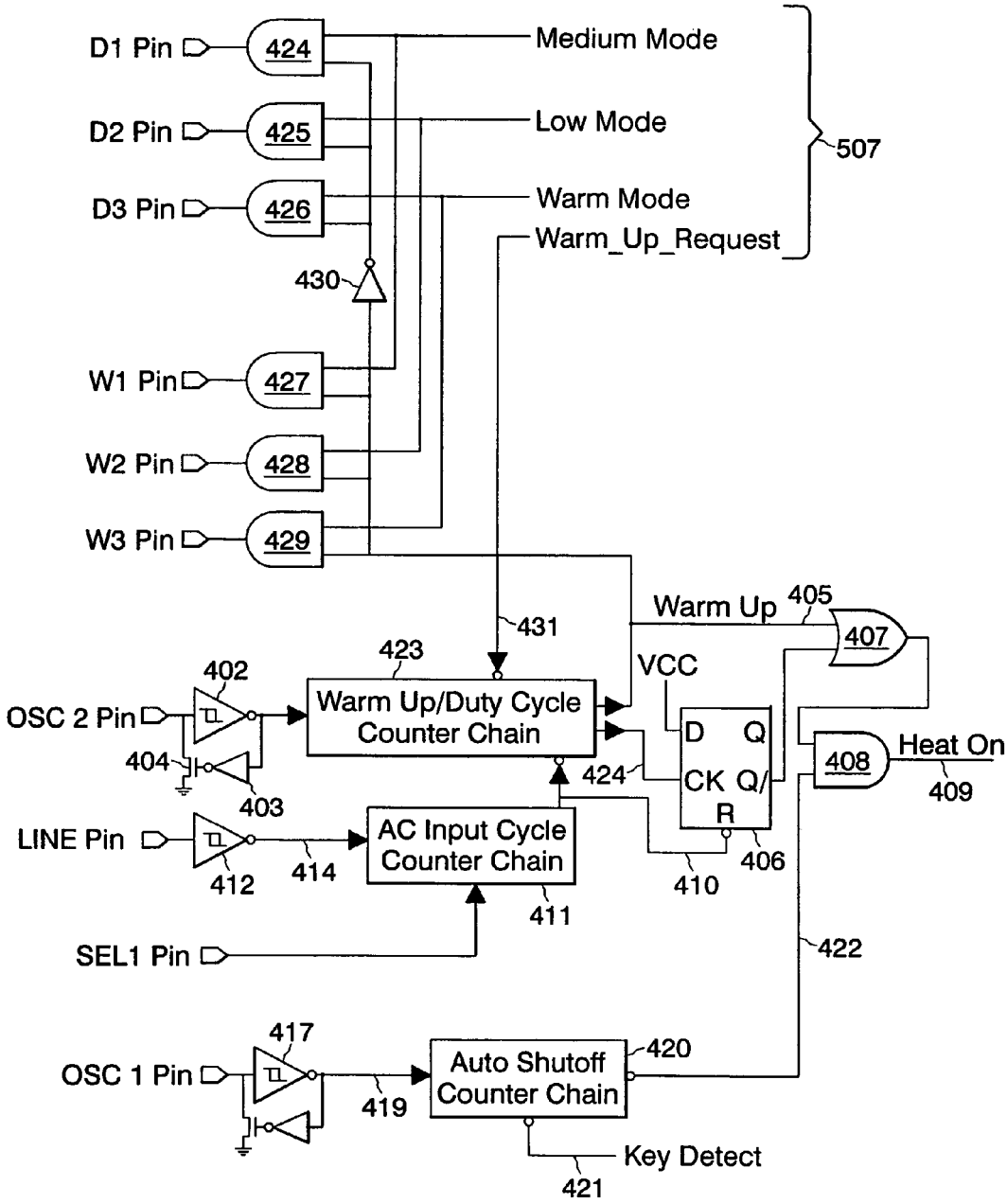
FIG. 4 is an electrical circuit schematic of circuitry that is internal to the ASIC of a heating pad controller according to the present invention.

FIG. 4 shows the internal circuitry of ASIC 109 responsible for controlling the duty cycle for heating pad controller 100. ASIC 109 OSC2 pin and LINE pin are inputs for AC signals which supply an oscillation frequency used to control the state of Heat ON signal 409, responsible for providing power to the heating element of a heating pad. The oscillator frequency generated at the output of Schmidt trigger 402 is coupled to a Warm up/Duty cycle counter chain 423. Warm up/Duty cycle counter chain 423 begins at 0 and counts oscillator cycles until the predetermined count required for duty cycle mode has been reached, at which time Warm up/Duty cycle counter chain 423 outputs a counter overflow signal 424 to the clock input pin of D flip-flop 406. Since in duty cycle mode Warm Up signal 405 (input to OR gate 407) is held at a logic low by counter chain 423, the output of OR gate 407 is controlled by the state on the Q-bar output of the D flip flop 406. Thus, when Warm up/Duty cycle counter chain 423 overflows, Q-bar switches from a logic high to a logic low state, the output of OR gate 407 drops low causing the output of AND gate 408 to drop low and current flow to the heating pad is turned off. If the turn off of the heating pad due to the overflow of counter 423 occurs before AC input cycle counter chain 411 outputs reset signal 410, the Heat On signal 409 will be a square wave with a duty cycle less than 100%. AC input cycle counter chain 411 counts a predetermined number of oscillator cycles and when it reaches its count it outputs a reset signal 410, resetting D flip-flop 406 and Warm up/Duty cycle counter chain 423 and turning on current flow to the heating pad. Thus, if Warm up/Duty cycle counter chain 423 overflows before AC input cycle counter chain outputs reset signal 410, current flow to the heating pad is turned off for a period of time prior to the output of reset signal 410 by AC input cycle counter chain 411. However, if counter chain 423 does not reach its predetermined count prior to its reset by AC input cycle counter chain 411, heat will remain on. The higher the frequency at the ASIC 109 OSC2 pin, the faster Warm up/Duty cycle counter chain 423 will time out, with the result that the proportion of the heat-on time will be reduced.

Figure 5A:
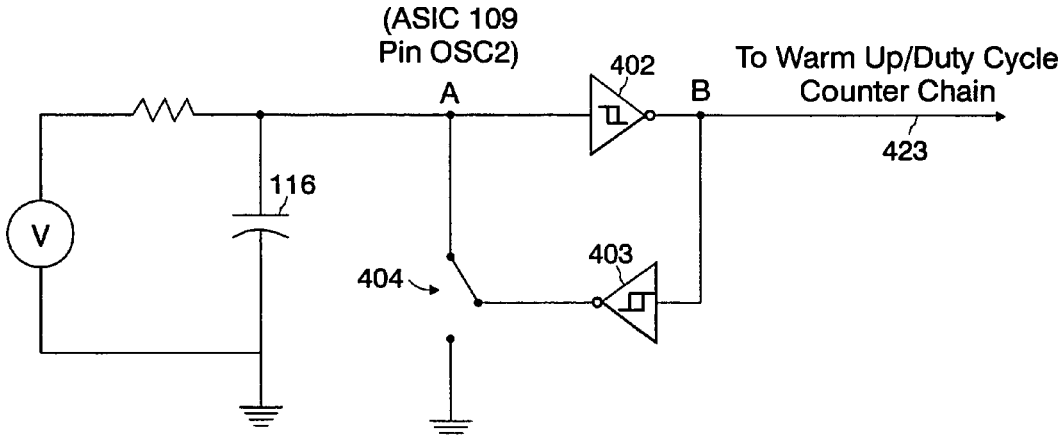
FIGS. 5*a*–5*b* are electrical circuit schematic diagrams for an oscillator circuit used in a heating pad controller according to the present invention.
Figure 5B:
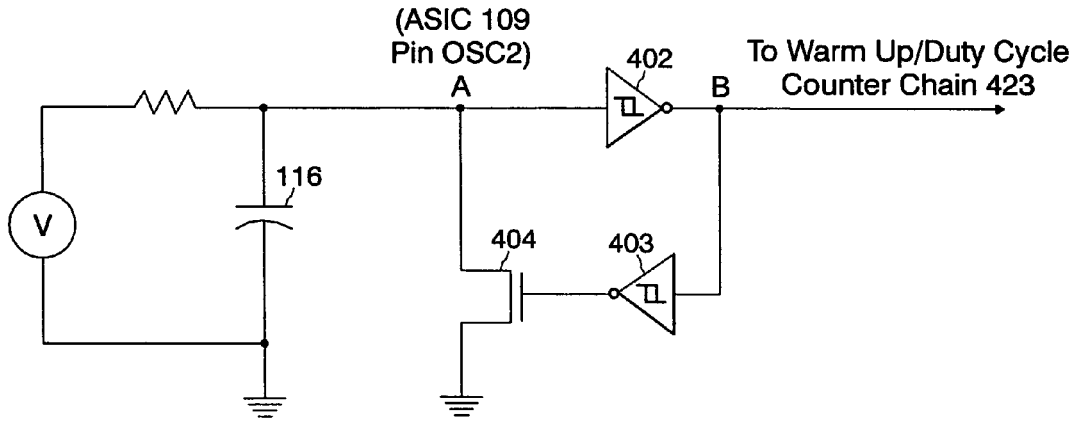
Figure 5C:
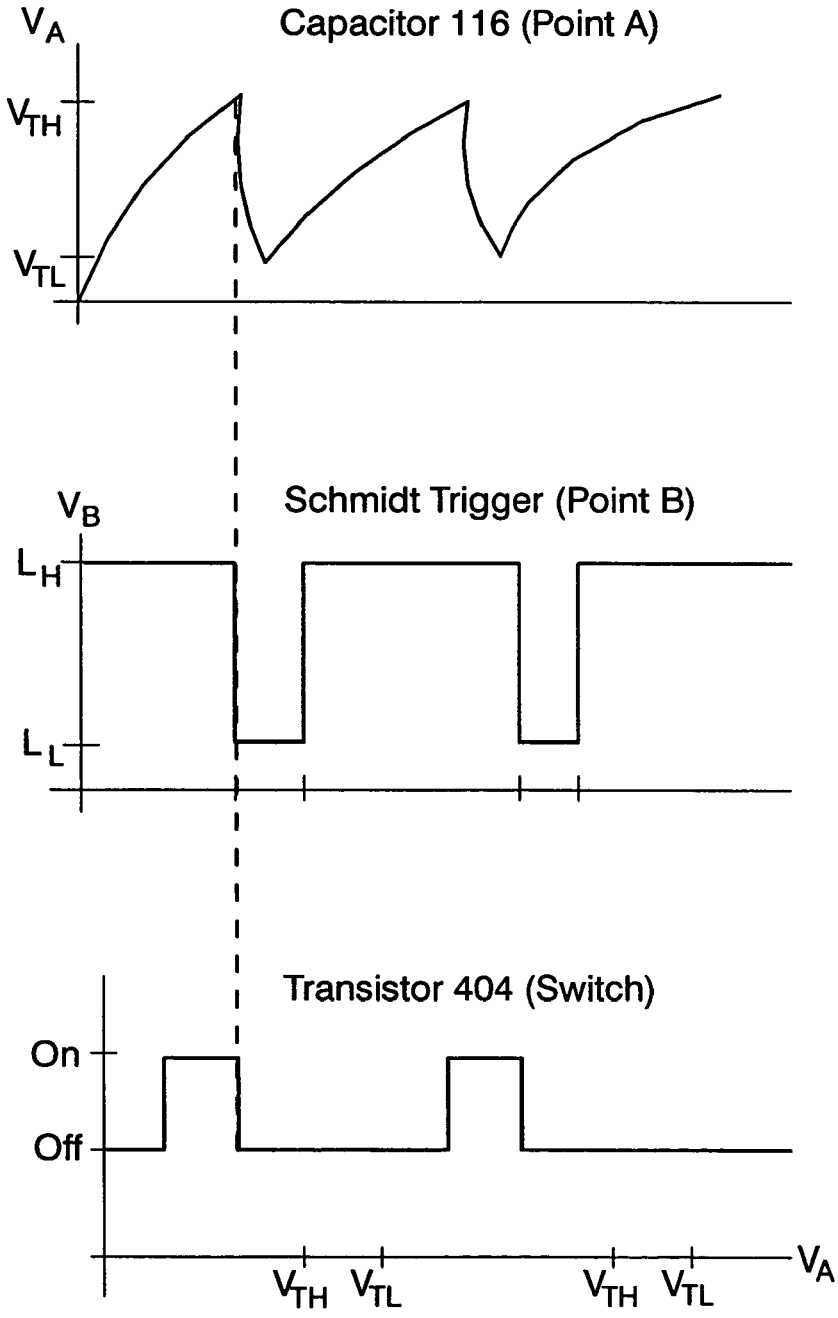
FIG. 5*c* is a timing diagram showing capacitor, Schmidt trigger, and transistor voltages in an oscillator circuit of an embodiment of FIGS. 5*a*–5*b;*
Figure 5D:
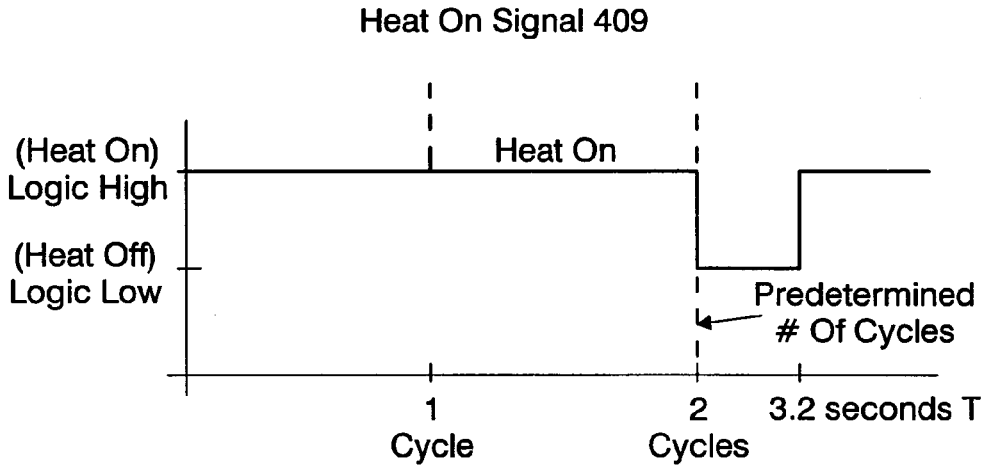
FIG. 5*d* is a timing diagram showing the on/off time in which power is delivered to a heating element in relation to the predetermined count of a counter according to the present invention.
Figure 5E:
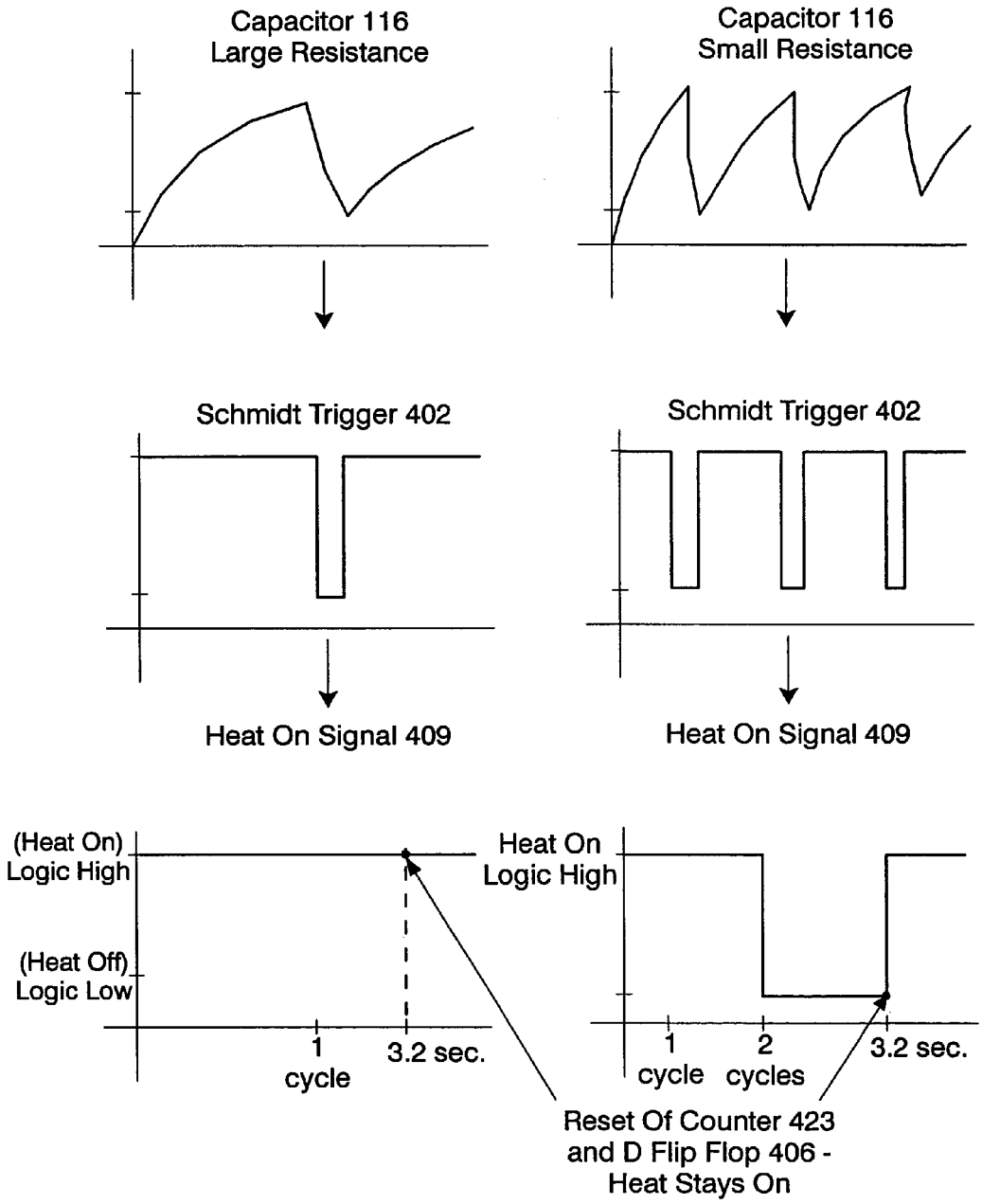
FIG. 5*e* is a series of timing diagrams of capacitor and Schmidt trigger voltages, and on/off time waveforms of power delivered to a heating element when the resistance of a resistor in an oscillator circuit of an embodiment of FIGS. 5*a*–5*b* is varied.

Capacitor 116 (FIG. 3) is connected to ASIC 109 at pin OSC2. As shown in FIG. 4, the OSC2 pin is connected to a Schmidt trigger 402 as well as to an open drain transistor 404. FIGS. 5*a* and 5*b* show electrical circuit schematic diagrams of an oscillator circuit comprising capacitor 116 (FIG. 3), any one of a plurality of duty cycles resistors, a supply voltage 105 (FIG. 3), Schmidt trigger 402 (FIG. 4), and transistor 404 (FIG. 4). FIG. 5*c* shows corresponding voltage and timing diagrams for capacitor 116, Schmidt trigger 402, and transistor 404 as capacitor 116 charges and discharges in the oscillator circuit of FIGS. 5*a* and 5*b*. Initially, the output of Schmidt trigger 402 is high and transistor 404 does not conduct, essentially, acting as an open circuit. Referring to FIG. 5*c*, when the voltage at the input of the Schmidt trigger 402 (point A; OSC2 pin), i.e., the voltage across capacitor 116, reaches a level sufficient to cause Schmidt trigger 402 to switch (high threshold voltage (Vth) of Schmidt trigger 402) the output of Schmidt trigger 402 goes from high to low. (The Schmidt trigger threshold voltage level is determined by the Schmidt trigger used and is an inherent characteristic of the part) The output of Schmidt trigger 402 is connected to the input of inverter 403 (point B) which inverts the signal output from Schmidt trigger 402 and applies this inverted output to the gate of transistor 404, causing transistor 404 to conduct, grounding the positive terminal of capacitor 116 (point A; OSC2 pin).

Transistor 404 turns on, creating a discharge path for capacitor 116. The positive terminal of capacitor 116 (Point A; OSC2 pin) is essentially grounded and capacitor 116 will now begin to discharge through transistor 404. When the voltage level at the OSC2 pin decays sufficiently, this causes the output of Schmidt trigger 402 to again change state, going from low to high. Schmidt trigger 402 will continue to change states in this manner as long as a constant voltage, equal to or greater than the Schmidt trigger threshold voltage, is applied to ASIC pin D3 (FIG. 3).

Referring to FIG. 5*c*, the voltage across capacitor 116 decays from Vth until it reaches the low switching voltage of Schmidt trigger 402 (Vtl), at which time Schmidt trigger 402 turns off transistor 404 and the capacitor 116 begins to charge. With a constant voltage applied to ASIC pin D3 and the capacitance of capacitor 116 held constant, the charge time for capacitor 116 is controlled by the resistance through which it charges. Referring to FIG. 5(*e*), the larger this resistance, the longer the charging time of the capacitor and the more time is needed for capacitor 116 to reach the high threshold voltage of Schmidt trigger 402. Thus, the oscillator circuit has a frequency of oscillation which is determined by the selection of a particular resistor connected to capacitor 116 (FIG. 3) in conjunction with the voltages provided by ASIC 109 at pins D1, D2, and D3 (FIG. 3). The frequency of oscillation can be increased or decreased by decreasing or increasing, respectively, the resistance of the resistor through which capacitor 116 charges. It will be understood to those of skill in the art that the frequency of oscillation output by the oscillator circuit can be increased or decreased by varying the impedance of a plurality of electrical circuit components included in the oscillator circuit and is not limited to selectably varying the resistance of a resistor. In an alternative embodiment, the resistance of a resistor through which the capacitor 116 charges can be held constant and the capacitance of the capacitor 116 can be selectably varied, varying the charge time of capacitor 116, resulting in a frequency of oscillation which is determined by the selection of a particular capacitor connected in the oscillator circuit.

Referring to FIGS. 3 and 4, an AC signal is applied to the LINE pin of ASIC 109 through resistor 107. The ASIC LINE pin is clamped internally to VCC and GND by clamping diodes (not shown), which are well known to those of ordinary skill in the art. Referring now to FIG. 4, the LINE pin is connected to Schmidt trigger 412, which takes the AC signal applied at its input and outputs a square wave. The square wave output of Schmidt trigger 412 is coupled to AC input cycle counter chain 411 which counts a predetermined number of oscillator cycles, and outputs a logic low reset signal 410 when it reaches its count. The logic low reset signal 410 is connected to the reset pin of D flip-flop 406 to reset the flip-flop, resulting in a logic high Q-bar output, each time AC input cycle counter chain 411 outputs a logic low reset signal 410. The Q-bar output of D flip-flop 406 is coupled to AND gate 408 through OR gate 407 to produce a Heat ON signal 409 whenever the output of OR gate 407 and enable signal 422 are both a logic high. Thus, each time AC input cycle counter chain 411 outputs a logic low reset signal 410, D flip-flop 406 is reset resulting in a logic high Q-bar output (input to OR gate 407) and the output of AND gate 408 (Heat On signal 409) changes from logic low to logic high.

AC input cycle counter chain 411 is preprogrammed to count a predetermined number of oscillator cycles before outputting a logic low reset signal 410. For example, for an applied AC signal of 50 Hz and AC input cycle counter chain 411 set to count 160 oscillator cycles, counter chain 411 will output a logic low reset signal 410 every 3.2 seconds (160 cycles/50 cycles/sec=3.2 seconds). The logic low reset signal 410 is coupled to the reset pin of D flip-flop 406 to reset the flip-flop every 3.2 seconds, causing the Q-bar output of D-flip flop 406 to change from a logic low to a logic high, or, in the event that the Q-bar output is already a logic high, reset signal 410 is ignored by the D-flip flop 406 and the Q-bar output remains a logic high. The Q-bar output of D flip flop 406 is coupled to AND gate 408 through OR gate 407 to produce a Heat ON signal 409 whenever the output of OR gate 407 and enable signal 422 are both a logic 1. Thus, the Q-bar output of D flip-flop 406 is set at 3.2 second intervals by the logic low reset signal supplied by AC input cycle counter chain 411 and the heating pad is turned on every 3.2 seconds. Enable signal 422, used to implement an auto shutoff feature as described below, is applied to AND gate 408 to turn heating off after the auto shutoff time has expired.

AC input cycle counter chain 411 is responsive to a signal at ASIC 109 input pin SEL1 to adjust AC input cycle counter chain 411 to accommodate either 50 Hz or 60 Hz AC cycles. ASIC 109 pin SEL1 insures that regardless of whether a 50 Hz or 60 Hz AC signal is applied to the LINE pin, the time at which AC input cycle counter chain 411 outputs a logic low reset signal 410 does not change. The logic low reset signal 410 is responsible for resetting D flip-flop 406 and Warm up/Duty cycle counter chain 423, and ultimately, for turning on current flow to the heat pad, as described in more detail below. Thus, for example, if the predetermined count of AC input cycle counter chain 411 was not changed to reflect a change in the AC input signal applied to the LINE pin, changing the applied AC signal from 50 Hz to 60 Hz (common when using a heating pad controller in countries which provide AC power at a frequency of 60 Hz) would cause AC input cycle counter chain 411 to output a logic low reset signal 410 sooner than it would if counting oscillation cycles of a 50 Hz AC signal, resetting Warm up/Duty cycle counter chain 423 sooner, and ultimately causing power to the heating element to remain on for a longer period of time.

If ASIC 109 pin SEL1 is left unconnected or connected to VCC, ASIC 109 is configured for 50 Hz operation, more specifically, AC input cycle counter chain 411 is set to count 160 oscillator cycles. If however, ASIC 109 pin SEL1 is connected to ground, as shown in FIGS. 3 and 7, ASIC 109 is configured for 60 Hz operation and AC input cycle counter chain 411 is programmed to count 192 oscillator cycles before outputting logic low reset signal 410. Thus, with an input AC signal of either 50 or 60 Hz, the time in which AC input cycle counter chain 411 outputs a logic low reset signal 410 will remain the same (i.e., 3.2 seconds in this example).

The oscillator frequency generated at the output of Schmidt trigger. 402 is coupled to Warm up/Duty Cycle counter chain 423. In duty cycle mode, Warm up/Duty Cycle counter chain 423 is reset every 3.2 seconds by reset signal 410 as described above. Upon being reset, counter chain 423 begins at 0 and counts oscillator cycles until the predetermined count required for duty cycle mode has been reached, at which time warm up/duty cycle counter chain 423 outputs a counter overflow signal 424 (low-to-high/high-to-low pulse) to the clock input pin of D flip-flop 406. The Q-bar output pin of D flip-flop 406 takes on the inverse of the state of the D input pin on the rising edge (low-to-high transition) of the clock signal and is an inherent characteristic of the D flip-flop. Thus, with the D input pin of D-flip flop 406 connected to VCC, the Q output pin will also be at VCC, resulting in a logic low at the Q-bar output of D flip-flop 406. In Duty cycle mode, Warm Up signal 405 (input to OR gate 407) is a logic 0 and is used primarily in WARM-UP mode as discussed below. Thus, Heat-On signal 409 is controlled by the logic state on the Q-bar output of D flip-flop 406. For example, when the Q-bar output of D flip-flop 406 is a logic 0, the output of OR gate 407 will also be a logic 0. The output of OR gate 407 is connected to the input of AND gate 408 making the output of AND gate 408 (Heat ON signal 409) logic 0 and heat will not be supplied to the heating pad. Thus, when counter chain 423 overflows resulting in a logic 0 on the Q-bar output of D flip-flop 406, Heat On signal 409 switches to a logic 0 state, turning off current flow to the heating pad. Heat On signal 409 will remain in a logic 0 state until the end of the 3.2 second time interval set by AC Input cycle counter chain 411, after which time warm up/duty cycle counter chain 423 and D flip-flop 406 are reset by reset signal 410 causing the Q-bar output of D-flip flop 406 to change from logic low to logic high and warm up/duty cycle counter chain 423 to begin its count from 0. In this manner, and with reference to FIG. 5*e*, if the overflow of counter chain 423 occurs before AC Input cycle counter chain 411 outputs reset signal 410, the Heat On signal 409 will be a square wave with a duty cycle less than 100%. However, if the overflow of counter 423 does not occur before counter 411 outputs a reset signal, both Warm up/Duty Cycle counter chain 423 and D flip-flop 406 will be reset by reset signal 410. Since Warm up/Duty Cycle counter chain 423 did not output count overflow signal 424 to drive the clock input pin of D flip flop 406, the Q and Q-bar outputs of D flip flop 406 remain unchanged (logic low Q; logic high Q-bar), the reset signal 410 is ignored by D flip flop 406 since there is nothing to reset and heat will continue to be supplied to the heating pad (Logic high Heat On signal 409). The higher the frequency at the OSC2 pin, the faster duty cycle counter 423 will time out, with the result that the proportion of time that the Heat On signal 409 is a logic high will be reduced. As shown earlier, the frequency at the OSC2 pin is controlled by the resistance of the resistor across which capacitor 116 charges, thus, by decreasing this resistance, resulting in a higher frequency of oscillation at the OSC2 pin, lower duty cycle can be achieved.

Referring to FIG. 3, controller 100 also includes a fast warm up circuit. When an operating mode is selected via switch S1, thereby turning on heating pad controller 100, ASIC 109 places the controller in high power mode, 100% duty cycle, for a period of time herein referred to as the "warm up time". This time varies with the heat setting and is set by external resistors 110, 111, and 112, which provide a selectable amount of current to charge up capacitor 116. Resistors 110, 111, and 112 are not limited to any specific resistance value, although typically the resistance of resistor 112 will be greater than the resistance of resistor 111 and the resistance of resistor 111 will be greater than the resistance of resistor 110. The increase in resistance causes a lower frequency of oscillation as discussed above, and results in Warm up/Duty cycle counter chain 423 taking longer to reach its predetermined count and heating pad controller 100 remaining in high power mode, 100% duty cycle, for a longer period of time.

Current to warm-up resistors 110, 111, and 112 is provided by ASIC 109 pins W1, W2 AND W3, respectively, thereby providing for the charging of capacitor 116 and setting the oscillator frequency at the OSC2 pin in a manner analogous to that described for setting the duty cycle time frequency. As mentioned above, the timing of the oscillator circuit is primarily determined by the charging of capacitor 116, which in turn is controlled by the resistance through which the capacitor charges. During warm-up mode, Warm up/Duty cycle counter chain 423 (FIG. 4) counts a predetermined number of oscillator cycles and, unlike duty cycle mode, when the predetermined count has been reached, power to the heating pad is maintained "on" and Warm-up/Duty cycle counter chain 423 switches from warm up mode to duty cycle mode. Thus, in warm up mode, resistors 110, 111, and 112 set a timeout value after which Warm Up/Duty cycle counter chain 423 switches from Warm Up mode to duty cycle operating mode.

Referring to FIG. 4, during Warm up mode, the Warm up/Duty cycle counter chain 423 provides a logic high Warm Up output signal 405 to OR gate 407. The output of OR gate 407 is applied to AND gate 408 to enable full power to be applied to the heating pad. The Warm up/Duty cycle counter chain 423 counts a predetermined number of oscillator cycles and when the predetermined count has been reached, Warm Up signal 405 is reset (changed from logic high to a logic low) and Warm Up/Duty cycle counter chain 423 switches from Warm Up mode to duty cycle operating mode. Warm Up signal 405 is also connected to the input of open-drain AND gates 424–429 and is responsible for controlling whether voltage is to be supplied to warm-up resistors while the ASIC is operating in Warm Up mode or duty-cycle resistors when the ASIC switches to Duty Cycle mode. For example, while in Warm Up mode, logic high Warm Up signal 405 input to open-drain AND gates 427–429 will allow a selected one of ASIC output pins W1, W2 or W3 to be active (ON). Which of ASIC output pins W1, W2 and W3 is active (ON) will depend on which heating mode is selected as represented by mode signal 507. The inverted output of warm up signal 405 (logic low), output of inverter 430, is connected to the input of open-drain AND gates 424–426. With a logic low input, the output of open-drain AND gates 424–426 will be open circuited as discussed above and the ASIC output pins D1, D2 and D3 corresponding to duty cycles resistors 113–115 will not be active (open circuit). Accordingly, when Warm Up/Duty cycle counter chain 423 switches from Warm Up mode to duty cycle operating mode, Warm Up signal 405 is reset, switching from logic high to logic low and ASIC output pins W1, W2 or W3 are turned off (open circuit) having a logic low warm up signal 405 input to open-drain AND gates 427–429 and a selected one of ASIC output pins D1, D2 and D3 will be active (ON). Which of ASIC 109 output pins D1, D2 or D3 is active (ON) will depend on which heating mode is selected as represented by mode signal 507. Mode signal 507 will be discussed in detail below.

In duty cycle mode, the predetermined count at which Warm up/Duty Cycle counter 423 will output a signal indicating that the required number of counts has been reached is lowered. To achieve fast warm up, the counter chain must be capable of counting oscillator cycles for a time period on the order of minutes and therefore must be a relatively long counter chain. The counter chain required for counting in the duty cycle mode is on the order of seconds; hence the need to utilize a different predetermined count value in duty cycle mode than is needed in Warm-up mode.

Referring to FIG. 3, after the quick warm-up period has expired with Warm up/Duty cycle counter chain 423 reaching its predetermined count of oscillator cycles, ASIC 109 turns outputs W1, W2 and W3 off, thereby ensuring that capacitor 116 is no longer being charged through resistors 110, 111, or 112. Instead, charging is accomplished through duty cycle resistors 113, 114, and 115 subject to the voltage levels appearing at ASIC 109 pins D1, D2, and D3 as described above.

During duty cycle mode, warm up signal 405 will remain logic low until a higher operating mode (heat setting) of heating controller 100 is selected via switch S1, at which time, Warm up request signal 431 is reset causing Warm up/Duty cycle counter chain 423 to switch back into warm up, mode. Entering warm up mode, warm up signal 405 switches from logic low to logic high and constant power (100% duty cycle) is delivered to the heating pad for the duration of the warm up period defined for the particular heat mode.

Controller 100 can operate at AC frequencies of 50 Hz or 60 Hz selectable via a logic level applied to ASIC 109 pin SEL1. Referring to FIG. 3, if selection pin SEL1 is left unconnected or connected to VCC, ASIC 109 is configured for 50 Hz operation. If, however selection pin SEL1 is connected to GND as shown, ASIC 109 is configured for 60 Hz operation.

Figure 8:
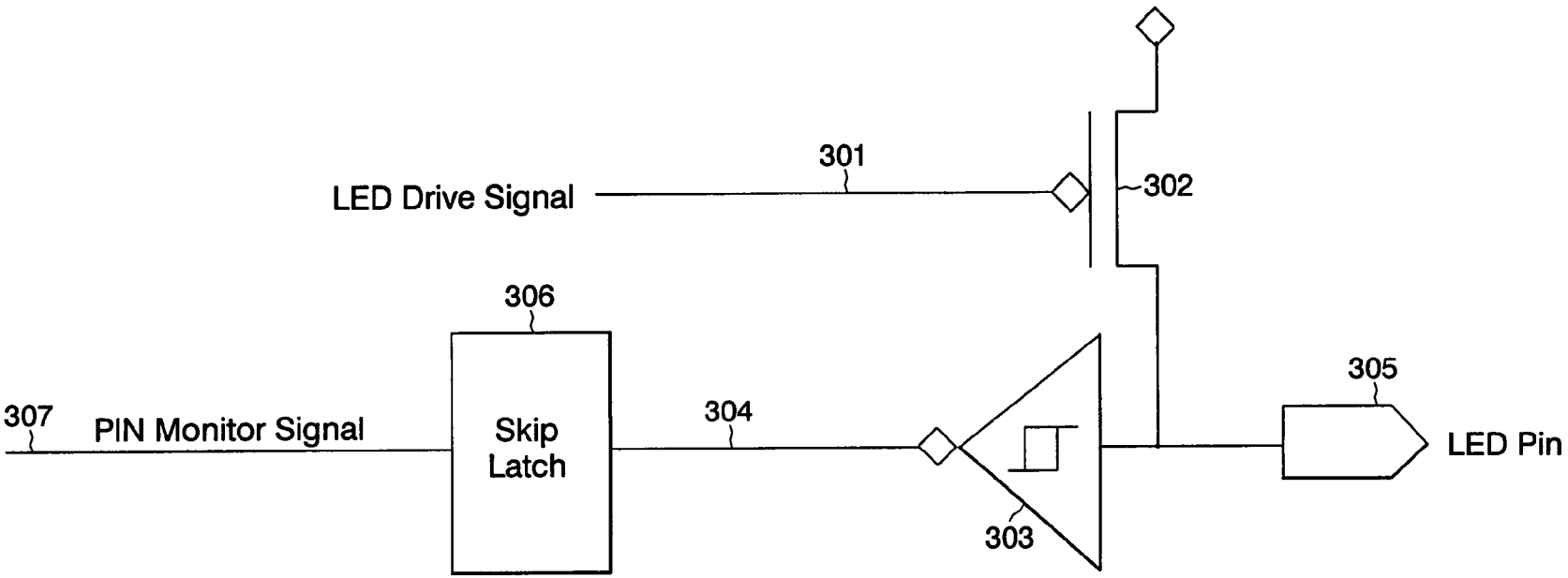
FIG. 8 is an electrical circuit schematic of circuitry that is internal to the ASIC of a heating pad controller according to the present invention.

Controller 100 also provides for direct drive of LEDS 118, 119, 120, and 121. The heat setting modes available for a particular controller model are selected during manufacture of the controller by connecting an LED corresponding to each available mode. Referring to FIG. 8, LED pin 305 corresponds to any one of a plurality of ASIC 109 pins assigned to an LED (i.e., LED1, LED2, LED3, etc) and representing an operation mode (heat setting) of heating pad controller 100. On power-up ASIC 109 checks for the presence of each LED corresponding to an operational mode by outputting a logic low LED drive signal 301 to the Gate of open drain transistor 302. If an LED is not present on a particular pin, essentially leaving the LED pin unconnected (opened), the voltage at LED pin 305 (Source of transistor 302) will approach VCC. However, if an LED is connected to pin 305, the voltage at pin 305 will be significantly lower than VCC due to the voltage drop across the LED. A Schmidt trigger 303 connected to LED Pin 305 produces an output signal 304, indicative of whether an LED is connected to pin 305. For example, if an LED is not present on ASIC pin 305, the voltage at LED pin 305 will approach VCC, reaching the threshold voltage of Schmidt trigger 303, causing the output of Schmidt trigger 303 to drop low. However, if an LED is present on ASIC pin 305, the voltage at pin 305 will not reach the switching voltage of Schmidt Trigger 303, keeping the output of Schmidt trigger 303 unchanged (logic high). The output of Schmidt Trigger 303 is latched by a skip latch 306 which effectively records whether an LED is present on an LED Pin by monitoring the high or low output voltage of Schmitt Trigger 303. Skip latch signal 307, along with the skip latch signals of the other ASIC pins assigned to LEDS, are used by ASIC 109 to determine which operating modes (if any) should be skipped. For example, if a logic high Schmidt trigger output signal 304 is input to Skip latch 306, indicative of the presence of an LED connected to LED pin 305, Skip latch 306 will output a Skip latch signal 307 allowing the operational mode assigned to the specific LED pin. However, if a logic low Schmidt trigger output signal 304 is input to Skip latch 306, indicative of the absence of an LED at LED pin 305, Skip latch 306 will output a Skip latch signal 307 preventing the operational mode assigned to that specific LED pin. In this manner, the heat modes available for heating pad controller 100 are selected by the connection of an LED, or absence thereof, corresponding to each available mode.

According to an alternative embodiment, in the event that an operational mode (heat setting) is desired in heating pad controller 100 and an LED is not desired for that particular heat mode the corresponding LED Pin can be shorted to ground. With the LED pin 305 shorted to ground, there is effectively a zero voltage at the input of Schmitt trigger 303, thus, Schmidt trigger 303 will not switch its output from high to low and ASIC 109 will allow the operational mode while an LED is not present at the LED pin. The level detector (Schmidt Trigger 303) and Skip Latch 306 records the fact that the operational mode is desired as discussed above, while an LED is not present at the pin.

The information from the skip latch 306 is used during operation to control whether a heating mode is skipped or implemented in the heating pad controller. For example, referring to FIG. 3, if the LED 120 were omitted by leaving ASIC 109 pin LED3 open, the omission would be detected on power up, and the skip latch 306 corresponding to the LOW mode would be reset. Therefore, the pushbutton or slide switch corresponding to the LOW mode can be omitted if that setting is not desired for a particular heater control module. Thus, for example, in a second embodiment of a heating pad controller using a two-button switch configuration according to FIG. 7, if LED 120 is omitted by leaving ASIC 109 pin LED3 open; when a user presses the UP key 202 while in the WARM mode, the mode will change from WARM to MEDIUM, thereby bypassing the LOW mode.

Figure 6:
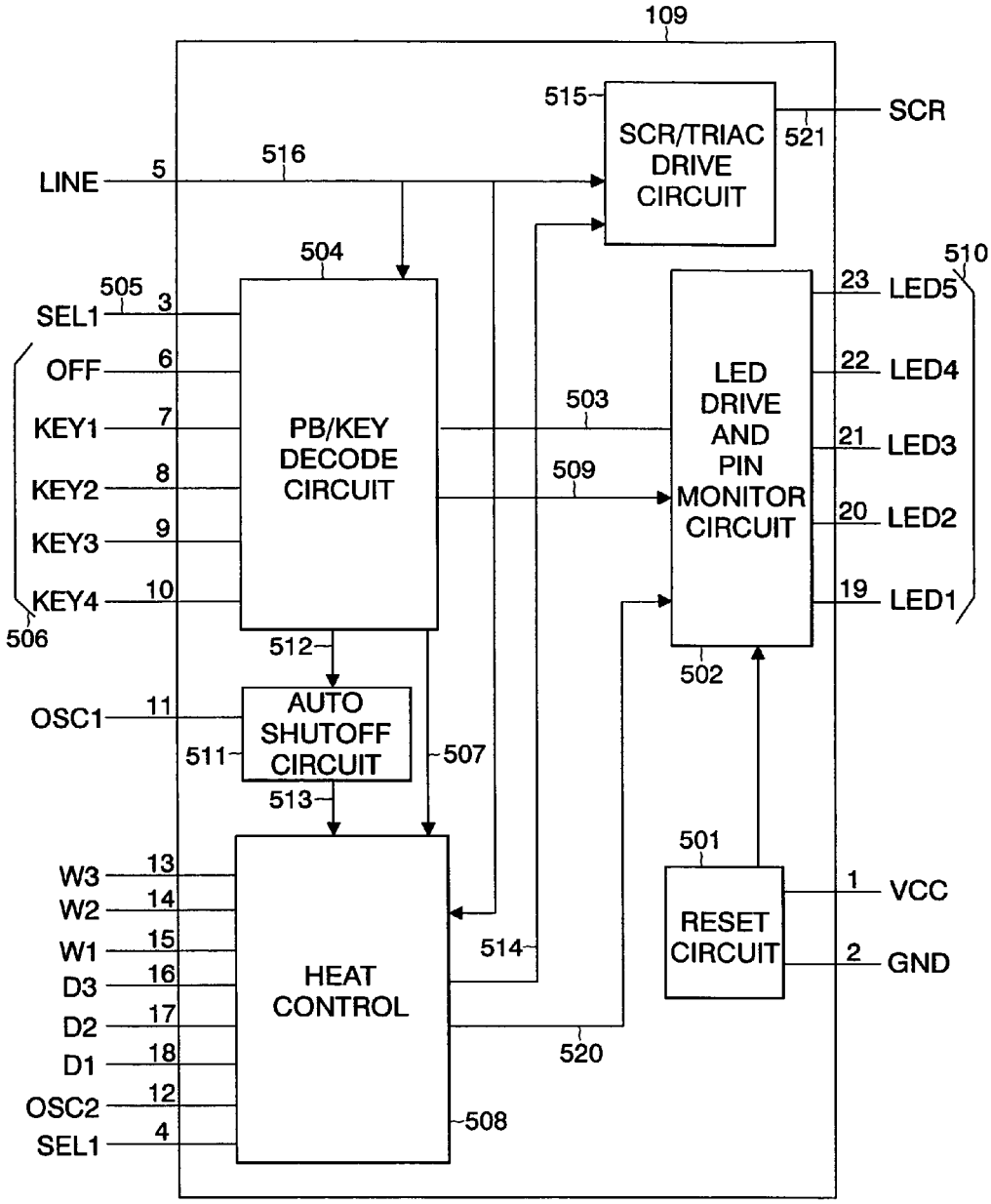
FIG. 6 is a block diagram of circuitry that is internal to the ASIC of a heating pad controller according to the present invention.

FIG. 6 is a simplified block diagram of the LED drive and pin monitor circuit 502 internal to ASIC 109. FIG. 6 also shows a simplified block diagram of the PB/key decode circuit 504. RESET CIRCUIT 501 is responsive to the power supply 105 (FIG. 3) voltage applied to ASIC 109 (VCC and GND) to set the ASIC circuitry to a predetermined initialization state when voltage is first applied to the ASIC, or upon removal and reapplication of voltage to the ASIC. Upon detecting a voltage from the power supply a reset condition is induced and RESET CIRCUIT 501 enables LED DRIVE AND PIN MONITOR CIRCUIT 502 to initiate a pin monitoring function as previously described, resulting in the setting or clearing of a skip latch for each of the ASIC 109 pins assigned to an LED. The skip latch signals 503, resulting from the detection of LEDS by LED DRIVE AND PIN MONITOR CIRCUIT 502 shortly after reset, are communicated as logic level signals to PB/KEY DECODE CIRCUIT 504, which uses the signals to determine which operating modes (if any) should be skipped. PB/KEY DECODE CIRCUIT 504 is responsive to a logic level at the SEL2 pin as previously described to enable the ASIC to be configured for use with either a pushbutton/slide switch arrangement or two-button, "increment mode", switch configuration. PB/KEY DECODE CIRCUIT 504 decodes key inputs 506 and outputs mode signal 507 to HEAT CONTROL 508.

As shown in FIG. 4, Mode signal 507 instructs ASIC 109 to supply voltage to one of ASIC output pins W1, W2, W3, D1, D2 or D3, driving a specific warm-up or duty cycle resistor used by heating pad controller 100 to implement a selected heat mode. This signal will change as the ASIC switches from warm-up mode to duty-cycle mode, turning off the ASIC 109 output pin voltage connected to the warm-up resistor used in warm-up mode and turning on the ASIC 109 pin voltage connected to the duty-cycle resistor which will be used for duty-cycle mode.

Mode signal 507 is input to HEAT CONTROL 508. When power to the heating element of a heating pad is required, HEAT CONTROL 508 outputs a logic high Heat ON signal 514. Heat on Signal 514 is input to SCR/TRIAC DRIVE CIRCUIT 515. An AC signal 516 applied to the ASIC 109 LINE input pin is provided to SCR/TRIAC DRIVE CIRCUIT 515 so that SCR/TRIAC DRIVE CIRCUIT 515 can output an SCR/TRIAC signal 521 coincident with zero crossings in a manner well know in the art. AC signal 516 is also applied to PB/KEY DECODE CIRCUIT 504 and HEAT CONTROL 508 which uses the signal as a time base for counting operations.

PB/KEY DECODE CIRCUIT 504 also outputs LED control signals 509 to LED DRIVE AND PIN MONITOR CIRCUIT 502 to turn LEDs 510 on or off appropriately depending upon the current operating mode.

Referring to FIG. 3, controller 100 can operate using one of two switch input configurations, selectable by connecting ASIC 109 pin SEL2 to either ground or power. If selection pin SEL2 is connected to GND, the ASIC 109 is configured to operate utilizing switch 108. Switch 108 is of either a slide or momentary pushbutton switch arrangement configured such that one of a plurality of ASIC pins is grounded. The switch positions represent the heat settings OFF, WARM, LOW, MEDIUM, and HIGH and correspond to ASIC 109 input pins OFF, KEY1, KEY2, KEY3, AND KEY4, respectively. Internal to ASIC 109, each input KEY pin is connected to an open drain transistor with an external pull-up resistor (not shown). Initially, the transistors connected to each KEY pin are off. When switch 108 is positioned over one of ASIC 109 pins KEY1, KEY2 OR KEY3 (e.g. KEY1), PB/Key Decode circuit 504 (FIG. 6) outputs mode signal 507 to heat control 508, responsible for supplying voltage to warm-up resistor 112 through ASIC 109 output pin W3 as described a above with reference to FIG. 4.

An alternative embodiment of a heating pad controller 100 as well as a second switch configuration is shown by controller 200 in FIG. 7. Here, ASIC 109 pin SEL2 is connected to VCC rather than GND. In this configuration, called increment mode, only the ASIC 109 pins corresponding to the Down key 201 and the Up key 202 are active. ASIC 109 pins OFF, KEY3, and KEY4, which correspond to OFF, MEDIUM, AND HIGH, in the embodiment of FIG. 3 are now grounded, as they will not be used in increment mode. On power-up, the first heat setting defaults to OFF and each push of the UP key 202 increments the heat setting through the available settings, such as WARM, LOW, MEDIUM, HIGH and back to OFF. The Down key 201 decrements the heat settings, terminating with the heat setting OFF.

Controller 200 includes a user safety feature designed to minimize and preferably eliminate any potential hazard due to a user inadvertently leaving the heating pad on. This feature includes an automatic shut off feature which turns off power to the heating pad when no user control, i.e., switch activation, is detected for a predetermined period of time, for example, 60 minutes. This is based on the premise that when no user control is detected for a sufficiently long period of time, this is a good indicator that the user has inadvertently left the heating pad on.

The Auto shutoff feature ensures that if a key is not pressed or a keyswitch setting remains unchanged for a predetermined period of time, the Heating pad will be turned off. Referring to FIG. 7, capacitor 204 and resistor 203 set an oscillator frequency in a manner analogous to that described previously with regard to the ASIC 109 OSC2 pin. Referring to FIG. 4, the OSC1 pin of the ASIC 109 (FIG. 3, FIG. 7) is coupled to schmidt trigger 417 resulting in an OSC1 signal 419 being applied to Auto shutoff counter chain 420. Auto shutoff Counter chain 420 counts OSC1 419 cycles, eventually reaching its predetermined count and timing out, producing a logic low timeout signal 422. Timeout signal 422 is applied to AND gate 408 to turn heating off after the Auto shutoff time has expired. When a key is pressed, key detect signal 421 resets Auto shutoff counter chain 420 causing the counter 420 to begin counting again at 0, and sets signal 422 to a logic 1, turning power to the heating pad back on. Thus, when a change in key state is detected, Key detect signal 421 resets Auto shutoff counter chain 420, heating is again enabled if it was previously disabled, and the auto shutoff counter begins counting from the beginning again. Additionally, when signal 422 is a logic 0, an LED flashes indicating to the user that the heating pad controller has timed-out. If a button corresponding to a heat setting is pushed or the slide selector moved, the timer is reset, the LED stops flashing and heat is applied to the pad. If ASIC 109 is operating in increment mode, the first push of a heat setting selection button returns the heating pad to the heat setting set prior to timing out. Also, if a heating pad controller according to any of the above mentioned embodiments is off due to time-out or is turned off for a period of less than 3.2 minutes, quick warm-up is suspended and the unit goes directly to the selected duty cycle mode.

While in the embodiment of FIG. 7, ASIC 109 OSC1 pin is connected to enable the oscillator to operate, in FIG. 3, the ASIC 109 OSC1 pin is connected to GND thereby disabling auto shutoff.

In an alternative embodiment of heating pad controller 200, if the ASIC 109 OSC1 pin (FIG. 4) is tied to VCC, ASIC 109 can be configured to set a customizable timeout time for the heating pad controller. In this embodiment, capacitor 204 and resistor 203 no longer set an oscillation frequency (signal 419) to drive auto shutoff counter chain 420, instead, reset signal 410 is input to Auto shutoff counter chain 420 and the counter is set to a predetermined number of counts. For example, ASIC 109 sets the timeout to be 60 minutes by selecting reset signal 410 to be input to counter chain 420 in lieu of signal 419 (OSC1 pin tied to VCC) and setting the auto shutoff counter chain 420 to 1125 counts (1125 counts/timeout*3.2 seconds/count=3600 seconds/timeout=60 minutes/timeout).

As shown in FIG. 6, Auto Shutoff circuit 511 operates as previously described and is reset upon receipt of a Key Detect signal 512 from PB/KEY DECODE CIRCUIT 504. Upon the Auto Shutoff circuit 511 timing out, timeout signal 513 is applied to heat control 508. Upon receipt of timeout signal 513, heat control 508 resets Heat ON signal 514, thereby ensuring that SCR/TRIAC DRIVE CIRCUIT 515 does not generate the output necessary to turn the heating pad on. Heat control 508 also generates a shutoff signal 520. This signal is applied to LED DRIVE AND PIN MONITOR CIRCUIT 502 which uses the signal to cause one or more LEDs to flash when a timeout has occurred.

While the invention has been particularly shown and described with reference to a preferred embodiment thereof, it will be understood by those skilled in the art that various changes in form and details may be made therein without departing from the spirit and scope of the invention.

The invention claimed is:

1. A controller for a heating device for controllably applying power to a heating device and controlling the heating device temperature by varying the duty cycle characteristics of a periodic control signal, comprising:

an oscillator circuit operable to output a frequency signal;

a counter connected to the oscillator circuit operable to count oscillations of the frequency signal and output a periodic control signal based on said frequency signal;

a power supply circuit including a switch to thereby energize and de-energize said heating device;

an actuating circuit controlling said switch, said actuating circuit controlled by said periodic control signal, wherein said actuating circuit is operable to control said switch to energize said heating device during a portion of said periodic control signal;

a user controlled temperature adjustment circuit connected to the oscillator circuit, including means for varying the frequency of said frequency signal, whereby said periodic control signal is varied to thereby vary the heating device temperature, wherein said means for varying the frequency includes means for varying an impedance included in said oscillator; and a plurality of LEDS connected to said user controlled temperature adjustment circuit wherein said LEDS provide a means for selecting available heating modes of said controller, such that said controller provides for at least one heat mode by detecting the presence of at least one of said plurality of LEDS, and deactivates a heat mode in response to the absence of said at least one of said plurality of LEDS.

2. A controller for a heating device for controllably applying power to a heating device and controlling the heating device temperature by varying the duty cycle characteristics of a periodic control signal, comprising:

an oscillator circuit operable to output a frequency signal;

a counter connected to the oscillator circuit operable to count oscillations of the frequency signal and output a periodic control signal based on said frequency signal, said periodic control signal including an on time signal portion and an off time signal portion;

a power supply circuit including a switch operable to energize and de-energize said heating device;

an actuating circuit controlling said switch, said actuating circuit controlled by said periodic control signal, wherein said actuating circuit is operable to control said switch to energize said heating device during said on-time signal portion and de-energize said heating device during said off-time signal portion;

a user controlled temperature adjustment circuit connected to the oscillator circuit, including means for adjusting the oscillator circuit to thereby vary the frequency of said frequency signal, whereby said on time signal portion and said off time signal portion are varied to thereby vary the heating device temperature; and a plurality of LEDS connected to said user controlled temperature adjustment circuit wherein said LEDS provide a means for selecting available heating modes of said controller, such that said controller provides for at least one heat mode by detecting the presence of at least one of said plurality of LEDS, and deactivates a heat mode in response to the absence of said at least one of said plurality of LEDS.

3. A controller for a heating device for controllably applying power to a heating device and controlling the heating device temperature according to claim 2, further comprising:

a rapid heating control circuit constructed to control the switch means to energize said heating device for a predetermined time period upon activation of the controller by said user controlled temperature adjustment circuit to thereby rapidly increase the temperature of said heating device, whereby said rapid heating control circuit increases said signal on time by instructing said user controlled temperature adjustment circuit to vary the frequency of said frequency signal by varying an impedance included in said oscillator circuit.

4. A heating device temperature control apparatus for controlling the temperature of a heating device by applying electric power from a first power source to the heating device, comprising:

a first switch connected between the first power source and the heating device for switchably applying power to the heating device;

an oscillator circuit;

a second switch connected between a second power source and the oscillator circuit;

a counter connected to the oscillator circuit operable to count oscillations thereof and output an oscillation count value;

a control circuit connected to the counter and said first and second switches, said control circuit operable to control the first switch to thereby switchably connect the first power source to the heating device when the oscillation count value of the counter is below a predetermined count value and to disconnect the power source from the heating device when the oscillation count value reaches the predetermined count value;

said control circuit operable to control the second switch to thereby switchably connect the second power source to the oscillator circuit when a voltage associated with the oscillator circuit is below a predetermined voltage value and to disconnect the second power source from the oscillator circuit when the voltage reaches the predetermined voltage value, and to switchably reconnect the second power source to the oscillator circuit when the voltage reaches a second predetermined voltage value;

a user controlled temperature adjustment circuit connected to the oscillator circuit, including means for adjusting the oscillator circuit to vary a frequency of oscillation therein, thereby varying a time interval during which the oscillation count value of the counter is below the predetermined count value and in which the control circuit instructs the switch to connect the first power source to the heating device, wherein said means for adjusting the oscillator circuit includes means for varying an impedance included in said oscillator circuit; and a plurality of LEDS connected to said user controlled temperature adjustment circuit wherein said LEDS provide a means for selecting available heating modes of said controller, such that said controller provides for at least one heat mode by detecting the presence of at least one of said plurality of LEDS, and deactivates a heat mode in response to the absence of said at least one of said plurality of LEDS.

5. A heating device temperature control apparatus according to claim 4, further comprising:

a rapid heating control circuit operable to control the first switch to connect the power source to the heating device for a predetermined time period upon activation of the controller by said user controlled temperature adjustment circuit to thereby rapidly increase the temperature of said heating device, whereby said user controlled temperature adjustment circuit selects at least one of a plurality of selectable impedances to thereby provide a lower frequency of oscillation output by said oscillator circuit and an increased time interval during which the oscillation count value of the counter is below the predetermined count value, and when said oscillation count value reaches the predetermined count value the control circuit instructs the first switch to continue to connect the first power source to the heating device and the temperature adjustment circuit de-selects said at least one of said plurality of selectable impedances and selects a second of said plurality of selectable impedances used to implement the selected heating mode, wherein said second of said plurality of selectable impedances provides a higher frequency of oscillation output by said oscillator circuit than said first.

6. A heating device temperature control apparatus according to claim 4, further comprising:

a second control circuit connected to said user controlled temperature adjustment circuit, constructed to output a second control signal indicative of whether an LED is connected to said user controlled temperature adjustment circuit for each of said heat modes; and a monitoring circuit connected to said second control circuit which receives said second control signal and records whether an LED is connected to said user controlled temperature adjustment circuit for each of said heat modes, wherein said monitoring circuit controls said controller to allow the operation of said heat mode upon detection of said LED associated with said heat mode and to prevent the operation of the heat mode in response to the absence of said LED.

7. A heating device temperature control apparatus according to claim 6, wherein said second control circuit comprises a Schmidt trigger operable to sense a voltage across said LED and output a signal indicative of whether said at least one of said plurality of LEDs is connected to said user controlled temperature adjustment circuit.

8. A heating device temperature control apparatus according to claim 6, wherein said monitoring circuit comprises a skip latch operable to monitor said second control circuit and record whether at least one of said plurality of LEDs is connected to said user controlled temperature adjustment circuit.

9. A heating device temperature control apparatus according to claim 3, wherein the user controlled temperature adjustment circuit selectively operates using one of a plurality of switch modes.

10. A controller for a heating device for controllably applying power to a heating device and controlling the heating device temperature according to claim 9, wherein said switch modes comprise either a slide switch configuration or momentary pushbuttons.

11. A heating device temperature control apparatus according to claim 3, wherein the heating device temperature control apparatus is an ASIC.

12. A heating device temperature control apparatus according to claim 3, wherein the heating device comprises a heating pad.

13. A heating device temperature control apparatus according to claim 4, wherein the user controlled temperature adjustment circuit selectively operates using one of a plurality of switch modes.

14. A controller for a heating device for controllably applying power to a heating device and controlling the heating device temperature according to claim 13, wherein said switch modes comprise either a slide switch configuration or momentary pushbuttons.

15. A controller for a heating device for controllably applying power to a heating device and controlling the heating device temperature by varying the duty cycle characteristics of a periodic control signal, comprising:

an oscillator circuit operable to output a frequency signal;

a counter connected to the oscillator circuit operable to count oscillations of the frequency signal and output a periodic control signal based on said frequency signal;

a power supply circuit including a switch to thereby energize and de-energize said heating device;

an actuating circuit controlling said switch, said actuating circuit controlled by said periodic control signal, wherein said actuating circuit is operable to control said switch to energize said heating device during a portion of said periodic control signal;

a user controlled temperature adjustment circuit connected to the oscillator circuit, including means for varying the frequency of said frequency signal, whereby said periodic control signal is varied to thereby vary the heating device temperature, wherein said means for varying the frequency includes means for varying an impedance included in said oscillator circuit; and said controller operable at a plurality of frequencies of a power supply.

* * * * *